United States Patent [19]

Shero

[11] Patent Number: 4,879,784

[45] Date of Patent: Nov. 14, 1989

[54] BI-DIRECTIONAL SQUEEGEE JET WAND

[76] Inventor: William Shero, 30961 Steeplechase, San Juan Capistrano, Calif. 92675

[21] Appl. No.: 230,071

[22] Filed: Aug. 9, 1988

Related U.S. Application Data

[63] Continuation of Ser. No. 900,769, Aug. 26, 1986, abandoned.

[51] Int. Cl.[4] ..... A47L 7/00; A47L 9/02

[52] U.S. Cl. ..... 15/322; 15/416

[58] Field of Search ..... 15/320, 321, 322, 416, 15/419, 415 R, 410

[56] References Cited

U.S. PATENT DOCUMENTS

| | | | |
|---|---|---|---|
| 3,747,155 | 7/1973 | Koellisch | 15/322 |
| 3,992,747 | 11/1976 | Hufton | 15/322 X |
| 4,521,935 | 6/1985 | Johnson et al. | 15/322 |

FOREIGN PATENT DOCUMENTS

| | | | |
|---|---|---|---|
| 2078496 | 1/1982 | United Kingdom | 15/322 |

*Primary Examiner*—Harvey C. Hornsby
*Assistant Examiner*—Scott J. Haugland
*Attorney, Agent, or Firm*—Stetina and Brunda

[57] ABSTRACT

A bi-directional squeegee jet wand for hard floor cleaning applications is disclosed, characterized by use of a pair of laterally spaced elongate vacuum ports, each of which carry a squeegee wiper blade upon its exterior portion which functions to accumulate spent cleaning solution in close proximity to a respective vacuum port during both forward and reverse manipulation of the wand upon the flow surface. A cleaning solution jet bar is positioned between the pair of vacuum ports such that the vacuum ports serve to deter splashing of the cleaning solution during dispensing which jet bar is advantageously removably mounted thereto permit use of the wand solely for solution extraction applications.

8 Claims, 2 Drawing Sheets

Fig. 4
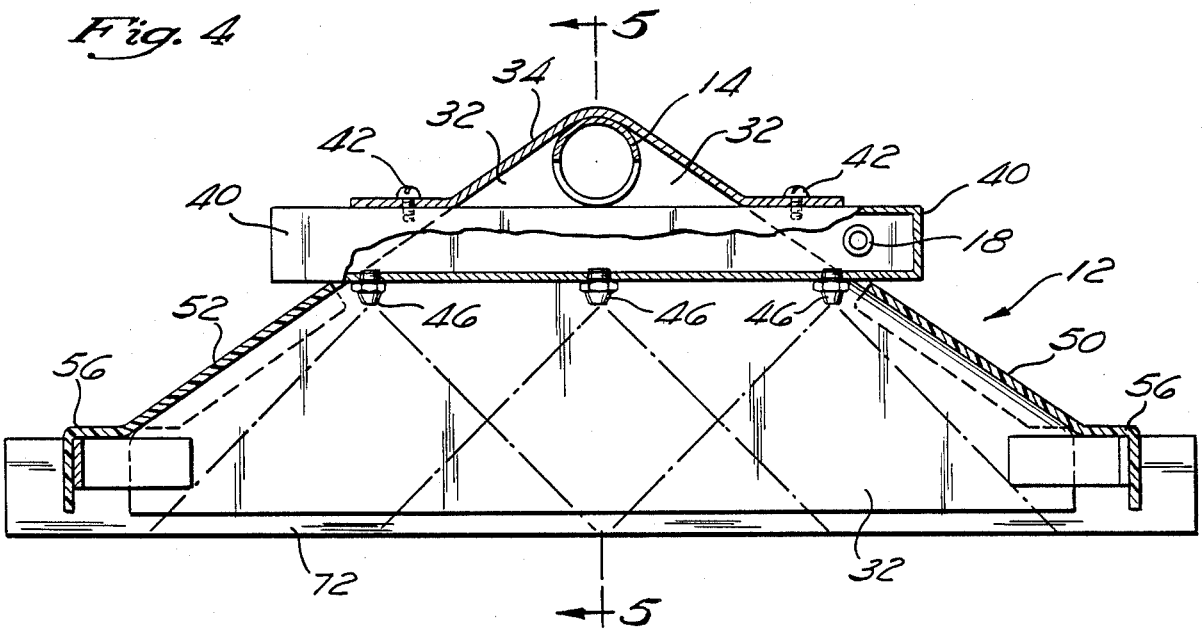
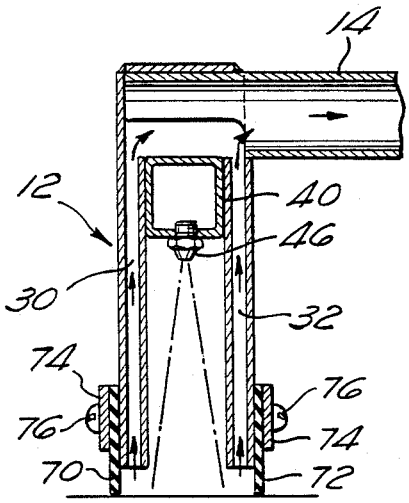
Fig. 5
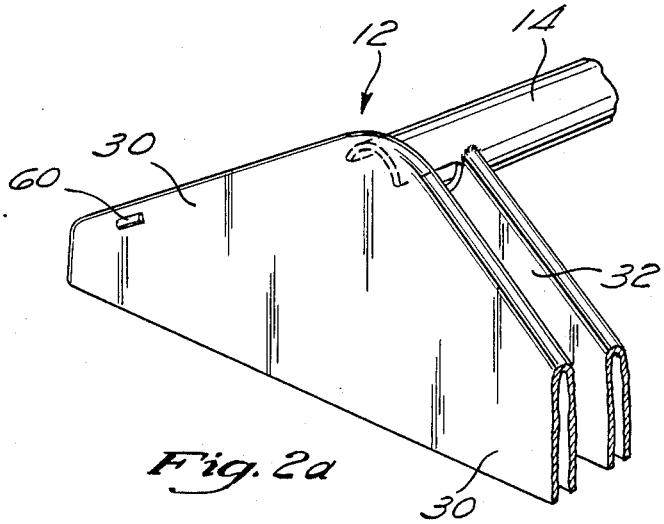
Fig. 2a
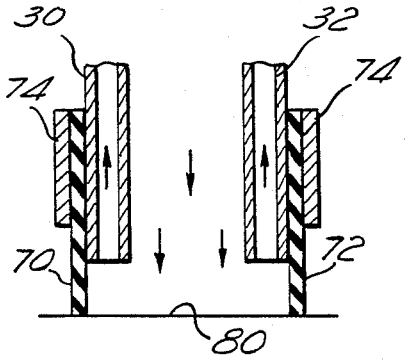
Fig. 6a
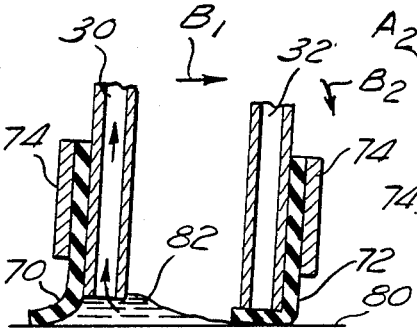
Fig. 6b
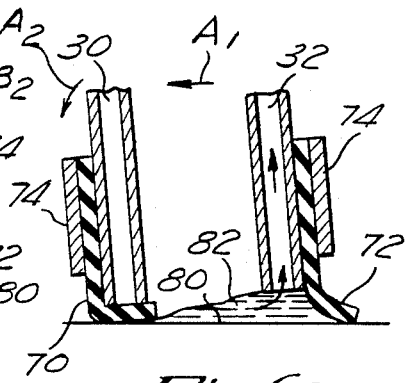
Fig. 6c

BI-DIRECTIONAL SQUEEGEE JET WAND

This application is a continuation of application Ser. No. 06/900,769, filed 8/26/86 now abandoned.

BACKGROUND

The present invention relates to floor cleaning apparatus and, more particularly, to an improved jet wand for hard floor cleaning applications, characterized by use of a pair of laterally spaced elongate vacuum ports, each of which carry a squeegee wiper blade upon its exterior portion which functions to accumulate spent cleaning solution in close proximity to a respective vacuum port during both forward and reverse manipulation of the wand upon the floor surface.

Prior art commercial cleaning systems for hard floor surfaces such as tile, linoleum, concrete, marble, wood and the like are well known. Typically, such prior art cleaning systems utilize a hand held wand through which a cleaning solution is directed under pressure onto the floor surface and subsequently extracted or removed from the floor surface by way of a vacuum port formed in the wand. To aid in the extraction process, prior art devices have utilized a squeegee wiper blade positioned adjacent to the vacuum port which strips the solution from the floor surface and directs the same toward the vacuum port. Although such prior art cleaning systems have proven generally effective, they possess inherent deficiencies which have detracted from their overall effectiveness in operation.

Foremost of these deficiencies has been the requirement for such prior art wands to be manipulated in solely one direction during the extraction of the cleaning solution from the floor surface. The requirement for single direction operation has been mandated due to the operation of the squeegee wiper blade of the prior art wherein it will only serve to strip water from the floor surface and accumulate the same adjacent the vacuum port in a single direction, whereas in the reverse direction, the squeegee will actually push the spent cleaning solution away from the vacuum port. As will be recognized, this single direction limitation in the prior art necessarily increases labor costs due to wasted motion and further, oftentimes prevents adequate floor cleaning in restricted area locations of the room, i.e. for instance in tight corners or the like.

In addition to the single direction limitations, the prior art cleaning devices have additionally been very prone to cleaning solution splashing during operation. The splashing deficiencies stem from the extremely high pressure supply of cleaning solution to the floor surface, typically being between 500 and 1000 pounds per square inch. As will be recognized, upon contacting the floor surface the cleaning solution has a high propensity to splash upwardly and outwardly from the wand, thereby oftentimes causing damage to surrounding environmental structures such as wall surfaces and furniture surfaces.

Further, the prior art squeegee wet wands have typically failed to provide easy cleaning and/or replacement of the cleaning solution supply system and squeegee wiper blade and additionally have been expensive to produce and use.

Thus, there exists a substantial need in the art for an improved squeegee jet wand for use in hard floor cleaning applications which may be effectively utilized in both forward and reverse directions, reduces splashing and facilitates rapid cleaning and repair of internal components of the jet wand.

SUMMARY OF THE PRESENT INVENTION

The present invention specifically addresses and alleviates the above-referenced deficiencies associated in the prior art. More particularly, the present invention comprises a bi-directional squeegee jet wand for hard floor cleaning applications which is characterized by use of a pair of laterally spaced elongate vacuum ports, each of which carries a squeege wiper blade upon its exterior surface which functions to accumulate spent cleaning solution in close proximity to a respective vacuum port during both forward or reverse manipulation of the wand upon the floor surface. The squeegee wiper blades are designed to selectively cover and uncover or partially cover and uncover a respective one of the dual vacuum ports such that maximum suction is developed between the squeegees to optimize extraction of the spent cleaning solution and additionally provide maximum direction or pooling of the spent cleaning solution adjacent one of the vacuum ports. Thus, labor time involved in extracting the spent cleaning solution from the floor surface is significantly reduced by way of the present invention's bi-directional operational characteristics.

In addition to the bi-directional extraction benefits of the present invention, the laterally spaced elongate vacuum ports permit the placement of a jet bar utilized for dispensing the cleaning solution onto the floor surface between the vacuum ports, whereby the vacuum ports themselves serve as a physical obstacle or splash guard barrier which prevents cleaning solution from exiting outward beyond the wand. In addition, to augment the reduced splashing characteristics made possible by positioning of the jet bar between the elongate vacuum ports, a pair of end splash guard covers may be utilized to form a complete enclosure within the wand, whereby any possibility of splashing of the dispensed cleaning solution upon the floor surface is eliminated.

Further, the jet bar assembly utilized in the present invention permits rapid replacement of the jet bar from the wand assembly to permit periodic maintenance of the same and/or rapid removal of the jet bar from the wand to facilitate use of the wand solely in solution extraction applications.

DESCRIPTION OF THE DRAWINGS

These as well as other featurres of the present invention will become more apparent upon reference to the drawings, wherein:

FIG. 2A is a partial perspective view depicting the construction of the pair of elongate vacuum ports utilized in the jet wand of the present invention;

FIG. 4 is a cross-sectional view taken through the dispensing and extraction head of the jet wand of the present invention;

FIG. 5 is a cross-sectional view taken about lines 5—5 of FIG. 4;

FIG. 6*a* is a schematic view of the vacuum ports and squeegee wiper blade during dispensing of the cleaning solution upon a floor surface;

FIG. 6*b* is a schematic view illustrating the position of the squeegee wiper blades during rearward manipulation of the jet wand of the present invention; and FIG. 6*c* is a schematic view illustrating the position of the squeegee blades during forward manipulation of the jet wand of the present invention.

DETAILED DESCRIPTION OF THE PREFERRED EMBODIMENT

Figure 1:
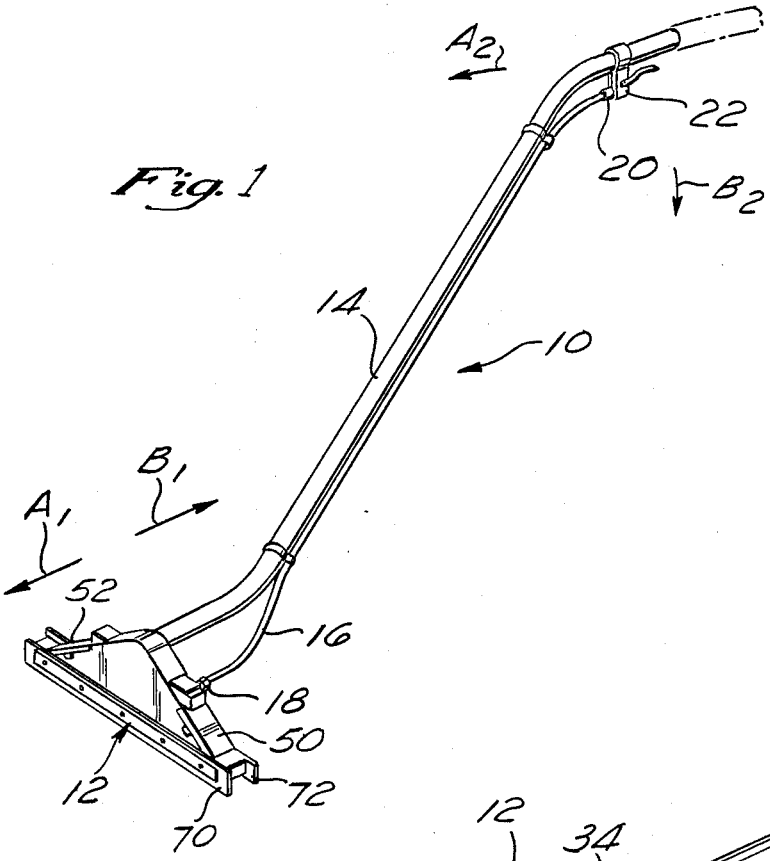
FIG. 1 is a perspective view of the bi-directional squeegee jet wand of the present invention.

Referring to FIG. 1, there is shown the improved bi-directional squeegee jet wand 10 of the present invention which is composed generally of a dispensing and extraction head 12 and elongate handle 14 which are connected adjacent the distal end of the handle 14. The handle 14 is preferably formed from suitable tubing such as stainless steel tubing, and is adapted at its upper most end to be connected to a conventional vacuum source of a cleaning system (not shown). The handle 14 additionally mounts a length of high pressure conduit 16 which is connected at one end via a suitable coupling 18 to the dispensing and extraction head 12 and at its opposite end via a coupling 20 to a trigger actuated normally closed valve 22. The valve 22 is adapted to be connected to a cleaning solution supply line (not shown) which additionally forms part of a conventional floor cleaning system. As will be recognized, upon connection of the jet wand 10 to the floor cleaning system, actuation of the valve 22 causes cleaning solution to be supplied to the dispensing and extraction head 12 via the conduit 16, which spent cleaning solution (i.e. the solution remaining upon the floor surface subsequent to dispensing) is extracted upward through the dispensing and extraction head 12 and through the interior of the handle 14.

Figure 2:
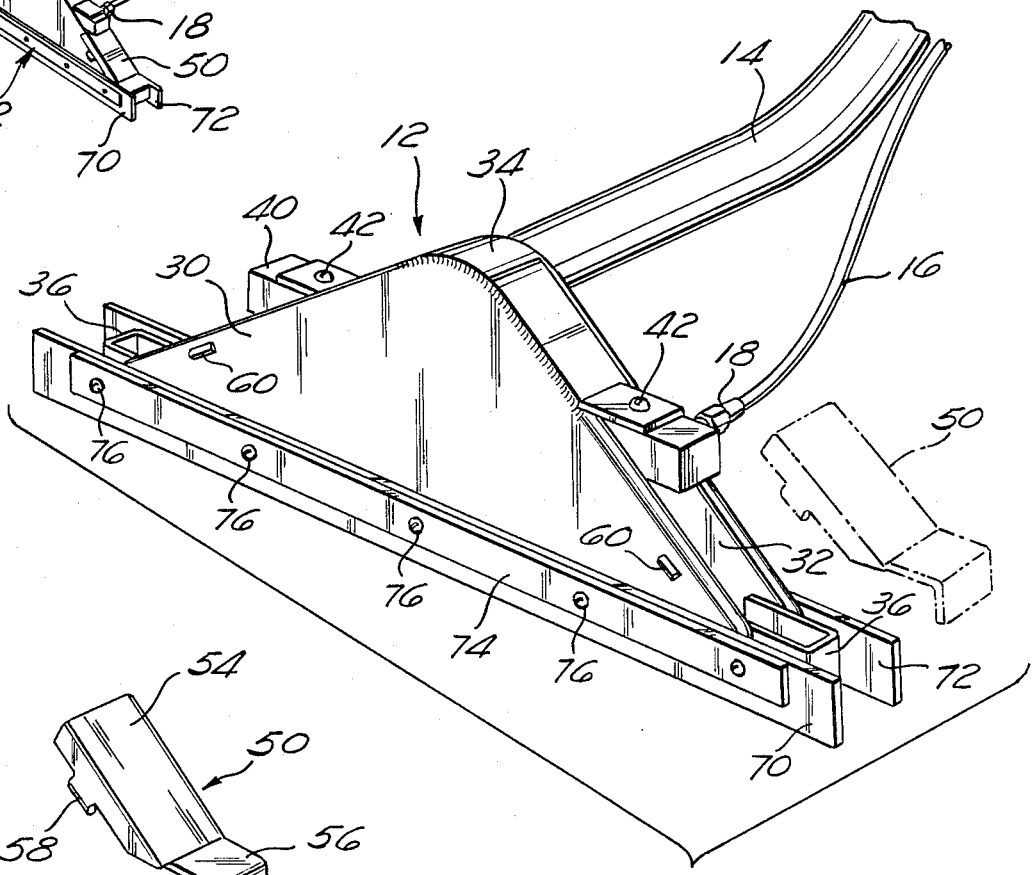
FIG. 2 is an enlarged partial perspective view of the dispensing and extraction head of the jet wand of the present invention.

Referring more particularly to FIGS. 2, 2A, 4 and 5, it may be seen that the dispensing and extraction head 12 also referred to as vacuum head is composed generally of a pair of substantially triangular shaped double walled vacuum ports 30 and 32 which are laterally spaced from one another and rigidly interconnected by way of an upper central mounting bracket 34 and pair of lower end brackets 36. Preferably, the elongate vacuum ports 30 and 32 are formed of stainless steel and are separated, i.e. laterally spaced from one another by a distance of approximately one to two inches. As best shown in FIGS. 2A and 5, the interior of the vacuum ports 30 and 32 are in flow communication with the interior of the handle 14 such that as a vacuum is applied to the interior of the handle 14 as by way of a conventional cleaning system (not shown), the same is communicated to the interior of the vacuum ports 30 and 32.

An elongate jet bar 40 comprising a closed ended reservoir having a rectangular cross-sectional configuration is disposed between the vacuum ports 30 and 32 and is removably mounted thereto by way of a pair of threaded fasteners 42 extending through the upper mounting flange 34. The coupling 18 extends through the wall of the jet bar 40 to permit flow communication between the conduit 16 and the interior of the jet bar 40. The lower surface of the jet bar 40 is provided with one or more venturi nozles 46 which preferably comprise inserts which may be threadingly received upon the jet bar 40 so as to provide flow communication with the interior thereof. The nozzles 46 are adapted to provide or dispense cleaning solution supplied to the jet bar downwardly against a floor surface at high pressure, i.e. approximately 1000 pounds per square inch, which high pressure flow cleans the floor surface.

Figure 3:
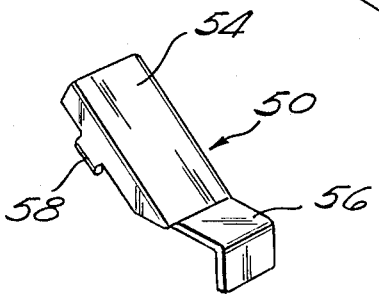
FIG. 3 is a perspective view depicting the end splash guard cover of the present invention.

As will be recognized, due to the jet bar 40 being disposed between the vacuum ports 30 and 32, during any dispensing of cleaning solution through the nozzles; the vacuum ports 30 and 32 form a physical barrier which serve to prevent or deter splashing of the cleaning solution outwardly from the dispensing and extraction head of the wand. To augment the reduced splashing characteristics of the wand 10, the present invention additionally contemplates the use of a pair of splash guard covers 50 and 52 which may be positioned on opposite ends of the dispensing and extraction head 12. As best shown in FIG. 3, the splash guard covers 50 include an inclined portion 54 sized to span the distance across the vacuum ports 30 and 32 and a substantially L-shaped end portion 56 sized to extend over the end mounting flanges 36. The inclined portion 54 additionally is provided with a pair of mounting tabs 58 which cooperate with a mounting shoulder 60 formed on the exterior surfaces of the vacuum ports 30 and 32.

In the preferred embodiment, the splash guard covers 50 and 52 are formed of a resilient plastic material such that the same can be selectively positioned and removed from the dispensing and extraction head 12 merely by snapping or unsnapping the tabs 58 from the shoulders 60. As best shown in FIG. 4, when the splash guard covers 50 and 52 are mounted upon the dispensing and extraction head 12, the interior region, i.e. cleaning chamber, defined between the vacuum ports 30 and 32 and beneath the jet bar 40 is in effect sealed or covered to prevent any splashing of any cleaning fluid dispensed through the nozzles 46 from exiting the interior region.

A pair of squeegee wiper blades 70 and 72 preferably formed from a resilient plastic or elastromeric material are mounted to the exterior surfaces of the vacuum heads 30 and 32 by way of an elongate retainer bar 74 and plural threaded fasteners 76. In the preferred embodiment, the squeegee wiper blades 70 and 72 extend downwardly below the lowermost surface of the vacuum ports 30 and 32 by a distance of approximately one-half inch, such that in operation, the squeegee wiper blades 70 and 72 contact the floor surface and thereby prevent any direct contact of the vacuum heads 30 and 32 thereto which could mar the floor surface.

With the structure defined, the operation of the bi-directional squeegee jet wand 10 of the present may be described, which is depicted schematically in FIGS. 6*a* through 6*c*. As depicted in FIG. 6*a*, during operation, a vacuum source (from a conventional cleaning system) is continuously applied via the interior of the handle 14 to the vacuum ports 30 and 32 such that any cleaning solution being present at the lowermost end of the vacuum ports 30 and 32 will be transported upwardly through the vacuum ports 30 and 32 in a direction indicated by the arrows in FIG. 6*a*. As will be recognized, any fluid so removed or extracted through the vacuum ports 30 and 32 travels upwardly through the interior of the handle 14 for ultimate disposal. When it is desired to dispense cleaning solution through the wand 10, manual activation of the trigger valve 22 causes cleaning solution to be dispensed through the jet bar 40 and downwardly onto the floor surface 80 in a direction indicated in the arrows in FIG. 6*a*. Due to the cleaning solution being dispensed between the vacuum ports 30 and 32 and squeegee wiper blades 70 and 72, the cleaning solution is confined between the vacuum ports and squeegee wiper blades so as not to splash outwardly from the wand 10.

When it is desired to extract the dispensed cleaning solution from the floor surface 8, the trigger valve 22 may be deactivated and the wand 10 may be manipulated either in a reverse (Arrow $B_1$) or forward (Arrow $A_1$) directions with attendant tilting (Arrows $A_2$, $B_2$) of the suction head as indicated in FIGS. **6*b* and 6*c* respectively. When manipulated in a reverse direction as indicated by the arrow in FIG. 6*b*, the lower portion of the wiper blade 72 may bend over or fold over to cover or partially cover the vacuum port 32, thereby causing the vast majority of the vacuum source to be supplied through the vacuum port 30 as indicated by the arrows in FIG. 6*b*. Such manipulation of the suction head 12 in the reverse direction (Arrow $A_1$), with attendant folding or bending of wiper blades 72 is accompanied by a slight tilting of the suction head 12 as indicated by Arrow $A_2$. Recognizing that the handle 14 is firmly attached to the suction head 12 to effect manual manipulation thereof, it will be recognized that such handle 14 will enable the operator to effect both forward-reverse (Arrows $A_1$, $B_1$) movement as well as attendant tilting (Arrow $A_2$, $B_2$) of the suction head 12. Further, in this reverse direction manipulation of the wand 10, the squeegee wiper blade 70 serves to pool the cleaning solution 82 in close proximity to the vacuum port 30 such that the same may be rapidly extracted from the floor 80 and upwardly through the vacuum port 30. Upon completion of a reverse direction manipulation of the wand 10, an operator may manipulate the wand in a forward direction as depicted by the arrow in FIG. 6*c*, wherein the squeegee wiper blade 70 folds over or bends over to cover or partially cover the vacuum port 30 and the squeegee wiper blade 72 springs outwardly so as to uncover the vacuum port 32 and cause cleaning solution 82 to be pooled or directed adjacent the vacuum port 32 for extraction from the floor surface. Thus, by way of the dual vacuum port and dual squeegee wiper blade design of the present invention, maximum extraction characteristics are exhibited by the selective partial covering and uncovering of opposite vacuum ports 30 and 32 during forward and reverse travel (Arrows $B_1$ and $A_1$) and attendant attitudinal tilting (Arrows $B_2$ and $A_2$) of the suction head 12 upon the floor surface 80**.

Those skilled in the art will recognize that although specific material configurations and specifications have been defined herein, modifications of the same can be readily made, and such modifications are clearly contemplated within the spirit of the present invention.

What is claimed is:

1. An improved cleaning wand for use in cleaning floors comprising:

a vacuum head having front and rear vacuum ports directed generally at right angles to said floor;

means disposed between said front and rear vacuum ports for spraying a cleaning solution upon a floor surface;

a handle cooperating with said vacuum head to manipulate said vacuum head in a forward and reverse direction upon the floor surface, said handle being further adapted to alternately tilt said vacuum head in said forward and said reverse directions as the operator manipulates said vacuum head in such directions; and at least one squeegee blade positioned outside of and adjacent to at least one of said vacuum ports, each such squeegee blade being directed downwardly from said vacuum head and terminating at a point below said vacuum ports and said means for spraying cleaning solution such that when said vacuum head is in its operative position said squeegee blade(s) will be in direct contact with said floor, with said vacuum ports and said means for spraying cleaning solution being held above said floor, said squeegee blade(s) being further adapted to assume an angular configuration of approximately ninety degrees thereby blocking said adjacent vacuum port upon movement of said vacuum head in the direction of each such squeegee blade.

2. The cleaning wand of claim 1 wherein said pair of vacuum ports are positioned relative said cleaning solution dispensing means to provide a physical barrier to prevent splashing of cleaning solution outwardly from said vacuum head.

3. The cleaning wand of claim 2 wherein said cleaning solution dispensing means comprises a reservoir having at least one nozzle for directing cleaning solution upon the floor surface.

4. The cleaning wand of claim 3 wherein said reservoir includes plural nozzles for directing cleaning solution upon the floor surface.

5. The cleaning wand of claim 3 wherein said handle comprises an elongate tubular member the interior of which is in flow communication with said pair of vacuum ports.

6. The cleaning wand of claim 5 further comprising a pair of splash guards mountable to said vacuum head and sized to span the lateral spacing distance between said pair of vacuum ports.

7. The cleaning wand of claim 6 wherein said pair of splash guards are removably mounted to said vacuum head.

8. A method of cleaning a floor by use of a squeegee jet wand comprising the steps of:

dispensing a cleaning solution upon a floor surface between a pair of laterally spaced vacuum ports directed perpendicularly to said floor surface;

directing the cleaning solution upon the floor adjacent one of said pair of vacuum ports during movement of said pair of vacuum ports in a first direction upon the floor;

directing the cleaning solution upon the floor adjacent the other one of said pair of vacuum ports during movement of said pair of vacuum ports in a second direction generally opposite to said first direction;

supplying a vacuum to said vacuum ports to extract said cleaning solution from said floor;

providing one or more squeegee blades extending downwardly adjacent each of said vacuum port, said squeegee blades being adapted to alternately bend in approximate 90-degree angles when said wand is alternately moved and slightly tilted in said first and second direction, said alternate 90-degree bending of said squeegee blades being effective to cause each said squeegee blade to periodically cover and effect blockage of at least one of said perpendicularly directed vacuum ports; and applying alternate movement and tilting of said wand in said first and second directions, thereby causing coincidental bending of said squeegee blades in alternating synchrony with said movement and tilting of said wand.

* * * * *